United States Patent [19]

Davidson

[11] 4,413,726

[45] Nov. 8, 1983

[54] DISPLAY BOX

[75] Inventor: Thomas L. Davidson, Montville, Conn.

[73] Assignee: Robertson Paper Box Co., Inc., Montville, Conn.

[21] Appl. No.: 340,258

[22] Filed: Jan. 18, 1982

[51] Int. Cl.[3] ..... B65D 5/66

[52] U.S. Cl. ..... 206/45.13; 206/45.23; 206/45.28; 206/45.29; 229/33; 229/44 R

[58] Field of Search ..... 206/44 R, 45.13, 45.18, 206/45.19, 45.2, 45.21, 45.23, 45.28, 45.29, 45.3, 301; 229/33, 36, 44 R; 220/18

[56] References Cited

U.S. PATENT DOCUMENTS

| | | | |
|---|---|---|---|
| 1,494,361 | 5/1924 | Lambert | 206/45.18 |
| 1,903,461 | 4/1933 | Keller | 206/45.29 |
| 1,966,662 | 7/1934 | Downs et al. | 206/301 |
| 2,322,849 | 6/1943 | Horr | 206/45.3 |
| 2,661,139 | 12/1953 | Brooks | 229/44 R |
| 2,951,583 | 9/1960 | Sanford | 206/45.13 |
| 3,572,576 | 3/1971 | Foster | 229/36 |
| 3,870,222 | 3/1975 | Butler | 229/44 R |
| 4,170,327 | 10/1979 | Bruml | 206/45.13 |

FOREIGN PATENT DOCUMENTS

| | | | |
|---|---|---|---|
| 1040140 | 10/1953 | France | 206/45.2 |

*Primary Examiner*—George E. Lowrance
*Assistant Examiner*—Jimmy G. Foster
*Attorney, Agent, or Firm*—Cesari and McKenna

[57] ABSTRACT

A display box formed from a single blank comprises a bottom section and a cover hinged to the rear wall of the bottom section so that the cover can swing between a closed position wherein it closes the bottom section and an open position wherein it lies at an obtuse angle relative to the bottom section. A display panel which is hinged between the front of the cover and the rear of the bottom section lies against the cover top wall when the cover is in its closed position and swings out of the cover to a substantially flat condition when the cover is in its open position to establish that open position and to function as an upwardly angled display panel. The box also includes stopper edges inside the cover for establishing the closed position of the cover.

16 Claims, 9 Drawing Figures

DISPLAY BOX

This invention relates to a cardboard carton or box. It relates more particularly to a box for protectively enclosing articles of merchandise during shipping and handling and which can also effectively and attractively display those articles when the box is open at the point of sale.

BACKGROUND OF THE INVENTION

It has become common practice to design boxes and other containers so that the boxes and containers provide a vehicle for advertising and displaying the box contents. In this, attractive designs are printed on the box with pictures of the articles contained in the box and with information about how the article operates or is intended to be used. Some such boxes have hinged covers which can be opened to display the box contents at the point of sale and then be reclosed upon purchase so that the articles in the box are protected while they are being transported to the buyer's destination. The box with which we are primarily concerned with here is of this general type.

An example of a prior container of this type is disclosed in U.S. Pat. No. 4,170,327. That patented carton has a molded plastic bottom section and a cardboard cover glued to the rear edge of the bottom section so that the two sections are hinged together permitting the cover to open and close. A guide panel is hinged between the bottom section and the cover which functions as a display panel when the box is opened and which also biases the cover to its open and closed positions.

That prior container is disadvantaged, however, in that it is relatively expensive to manufacture and assemble. This is because the bottom section of that container is a molded plastic piece. The cover section and guide panel, on the other hand, are made of cardboard and must be appropriately folded and then glued to the plastic bottom section. Resultantly, manufacture and assembly of that box is relatively time consuming.

Also, since the bottom section of that known container is a rigid plastic shell, the container cannot be shipped in a flattened condition from the box manufacturer to the filler and an inventory of such boxes takes up a large amount of warehouse space.

Another disadvantage of the prior box is that its appearance on the shelf when open or closed is not as attractive as one might wish. This is also due primarily to the fact that the prior carton is a hybrid construction composed of adhered-together cardboard and plastic parts.

SUMMARY OF THE INVENTION

Accordingly, the present invention aims to provide an improved box for containing and displaying articles of merchandise.

A further object of the invention is to provide a hinged-cover box which has an attractive appearance when the cover is either open or closed.

Yet another object of the invention is to provide a box of this type which is made entirely from a single blank of paperboard material.

Still another object of the invention is to provide a display box of this general type which is easy and economical to manufacture and erect.

Yet another object of the invention is to provide a hinged-cover display box which, when opened, completely exposes an interior display panel for advertising the box contents.

Still another object of the invention is to provide a hinged-cover display box whose cover is automatically biased to its open and closed positions.

A further object of the invention is to provide a blank for forming a hinged-cover display box having one or more of the aforesaid characteristics.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present hinged-cover box is formed from a single blank of paperboard material which only has to be finished and printed on one side in order to decorate all the exposed surfaces of the box whether the box is open or closed. The box comprises a generally rectantular open bottom section and a similarly shaped cover which is hinged to the rear of the bottom section along a hinge line spaced above the bottom wall of that section.

An interior panel for displaying printed advertising connects the bottom section and the cover. The display panel is hinged to the rear wall of the bottom section along a line spaced above the cover hinge and to the top wall of the cover at the forward edge thereof. At least two additional fold lines are scored in the display panel. One of these lines is situated directly opposite and parallel to the upper edge of the bottom section rear wall and the other is located between the last mentioned fold line and the hinge connecting the advertising panel to the forward edge of the cover. The locations of the fold lines in the display panel and the distances between them are such that, when the box is closed, the display panel lies flush against the top wall of the cover so that it does not interfere with the box contents. On the other hand, when the box is opened by swinging back the cover, the display panel swings out away from the cover so that its surface carrying the printed advertising is oriented upwardly and forwardly so that the advertising thereon is clearly visible to the observer.

The display panel performs other functions as well. First, the panel helps to establish the open position of the cover. Secondly, it biases the cover towards its open and closed positions. In this, the locations of the hinges on the display panel enable the panel to function as a bistable member with its stable positions existing only when the cover is at or near its open and closed positions. Thus, when the box is open as it may be be when displaying its contents, there is little likelihood of the cover being closed inadvertently due to strong air currents at the point of sale to casual contact by a passerby. Likewise, when the cover is closed, it will remain in that position.

Furthermore, as will be described in detail later, the box includes provision for positively establishing the closed position of the cover so that, when several closed boxes are arranged in stacks, they all present the same uniform, neat exterior appearance, which is quite desirable from a marketing standpoint.

The present box can protectively enclose articles nested in the box or the articles can be seated in appropriately shaped cavities of a molded platform situated in the box. In either event, the box constitutes a protective enclosure for the box contents. As will be discussed in greater detail later, the sides and corners of the box are all reinforced so that there is minimum tendency of the box to tear due to rough handling. On the other hand, when the box is open, it provides a very effective advertising display platform for the articles in the box.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
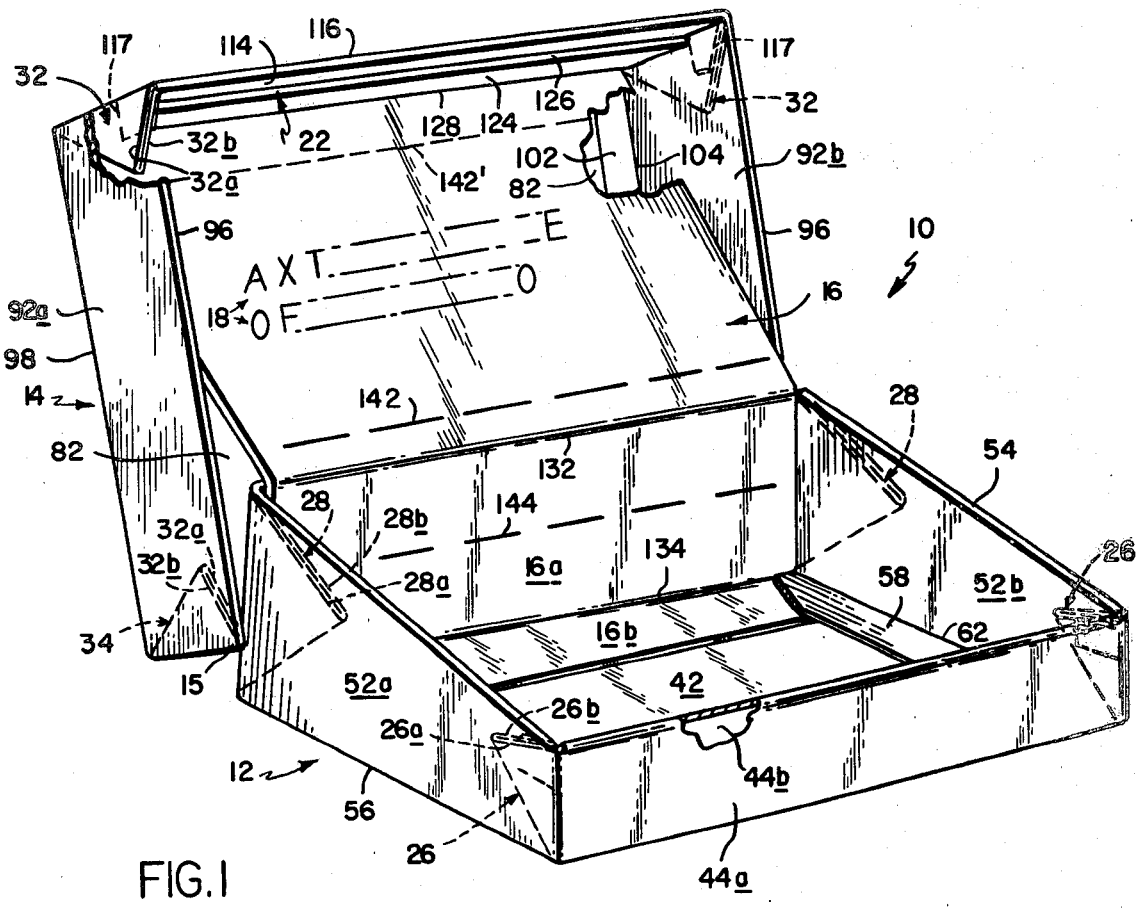
FIG. 1 is a perspective view with parts broken away showing a display box made in accordance with this invention, with the box cover being shown in its open position.
Figure 2:
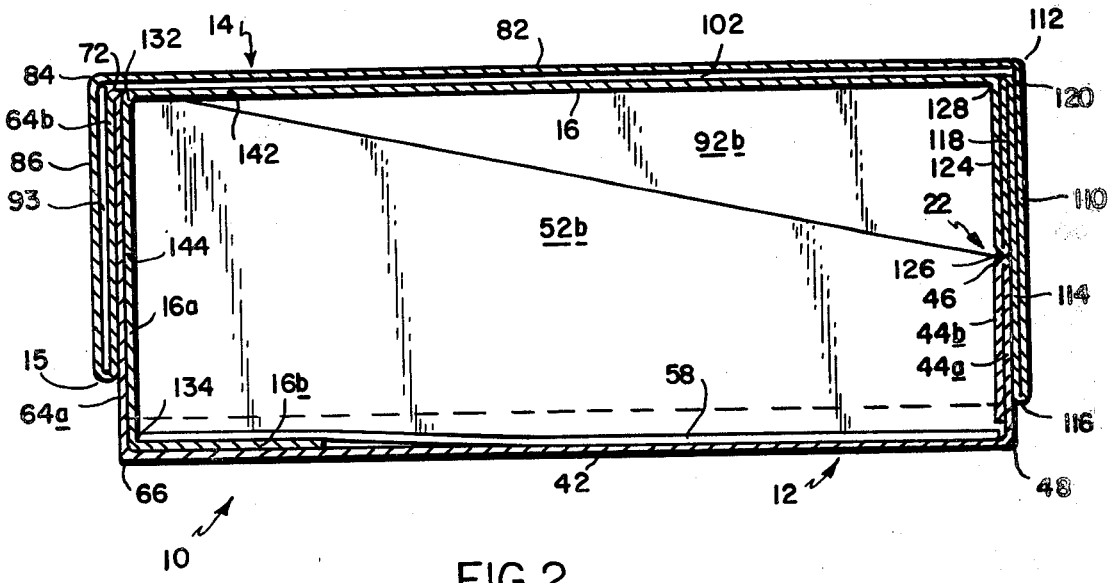
FIG. 2 is a vertical sectional view of the FIG. 1 box with its cover in the closed position.

Referring to FIGS. 1 and 2 of the drawings, a hinged-cover display box is indicated generally at 10. The box comprises a generally rectangular bottom section illustrated generally at 12 and a rectangular cover shown generally at 14 which is hinged at 15 to the rear wall of the bottom section 12. Cover 14 is swingable with respect to section 12 on its hinge line 15 from an open position illustrated in FIG. 1 to a closed position shown in FIG. 2. A rectangular display panel indicated generally at 16 is hinged between the bottom section 12 and the cover 14.

When the box is in its open condition shown in FIG. 1, panel 16 establishes an open position of the cover wherein the cover is oriented at an oblique angle relative to the bottom section. When the cover is positioned thusly, the advertising panel 16 is displaced away from the cover and angled forwardly and upwardly so that printed advertising indicated generally at 18 thereon is readily visible to an observer standing in front of the box.

When the cover 14 is moved to its closed position illustrated in FIG. 2, the panel 16 folds flush against the inside wall of cover 14 so that it does not interfere with or contact the box contents. Stop means shown generally at 22 are formed inside the cover adjacent its forward edge which means engage the bottom section 12 to positively establish the closed position of the cover in such a way that the cover edge lies parallel to the bottom of the box, giving the closed box a neat attractive appearance.

Panel 16 also functions as a bistable member which tends to bias cover 14 toward its open and closed positions. In this, the panel has an unstable condition when the cover 14 is partially closed so that, when the cover is fully open, it tends to remain in that position. By the same token, when the cover is closed, the box can be tipped and turned to a considerable extent without the box opening inadvertently.

Box 10 is also reinforced at the points of maximum stress. In this, its section 12 and cover 14 have side walls of double thickness. In addition, pleats 26 are formed at the front corners of section 12 adding extra material at those locations. Similar pleats 28 are provided at the rear corners of section 12. Reinforcing pleats 32 and 34 are present as well at the front and rear corners respectively of cover 14. Thus, when the box 10 is closed, it provides a very secure impact-resistant enclosure for the box contents. On the other hand, when the box is open, it provides a very attractive advertising and display setting for those contents.

Figure 4:
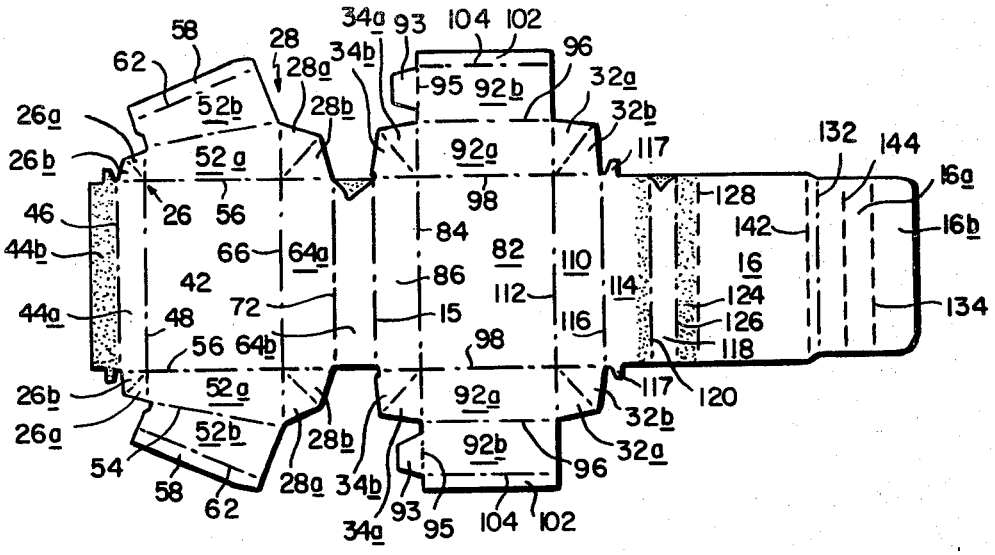
FIG. 4 is a top plan view illustrating the blank from which the FIG. 1 box is made.

Referring now to FIGS. 1, 2 and 4, the bottom section 12 comprises a generally rectangular bottom panel 42. The front wall of the bottom section is formed by an outer panel **44*a* and an inner panel 44*b* hinged together along fold line 46, the former panel being hinged to panel 42 along the fold line 48. Each of the bottom section side walls comprises an outer panel 52*a* and an inner panel 52*b* hinged together along an oblique fold line 54, the former being hinged also to panel 42 along a line 56. A narrow panel 58 is hinged at 62 to the free side edge of each panel 52*b* and it lies flush against the bottom panel 42 to reinforce the bottom edges of the box as shown in FIG. 1. Each pleat 26 is formed by a pair of hinged-together triangular panels 26*a* and 26*b* hinged to the corresponding panels 44*a* and 52*a***.

The carton rear wall is composed of an inner panel **64*a* hinged at 66 to the free side edge of bottom panel 42. An outer rear wall panel 64*b* is hinged at 72 to the free top edge of panel 64*a*. Panel 64*b* is folded flush against and adhered to panel 64*a* to form a laminated rear wall structure. The pleats 28 formed at the rear corners of section 12 are composed of hinged-together triangular sections 28*a* and 28*b* which are, in turn, hinged to the corresponding edges of panels 52*a* and 64*a***.

Still referring to FIGS. 1, 2 and 4, the cover 14 includes a top panel 82 to which is hinged at 84 a rear wall panel 86 which is, in turn, hinged to the lower edge of rear wall panel **64*b* of section 12. That hinge line is the overall cover hinge 15. Each cover side wall is formed by an outer wall panel 92*a* and an inner wall panel 92*b* which are hinged together at 96, with the former panel being hinged at 98 to wall panel 82. A narrow rectangular panel extension 102 is hinged at 104 to the edges of each panel 92*b* distal from the adjacent panel 92*a*. The pleats 34 at the rear corners of the cover 14 are formed by hinged-together triangular panels 34*a* and 34*b* which are, in turn, hinged to the adjacent edges of panels 86 and 92*a*. For added strength at the rear corners of cover 14, lateral flaps 93 are hinged at 95 to the side edge of each panel 92*b*. These flaps lie flush against rear wall panel 86 under display panel 16 (FIG. 2**).

The cover front wall is composed of an outer panel 110 hinged at 112 to the forward edge of panel 82. A panel 114 hinged at 116 to panel 110 is folded flush against and adhered to the inside surface of panel 110 to form the inside panel of the cover front wall. The pleats 32 at the front corners of cover 14 are composed of hinged-together triangular panels **32*a* and 32*b* hinged to the adjacent edges of panels 92*a* and 110. Small tabs 117 extend out from the opposite side edges of panel 114** which fold into pleats 32 for added corner reinforcement.

The stop means 22 identified above is composed of a short panel 118 hinged at 120 to the upper edge of panel 114 and folded against and adhered to the inside face of that panel. A second panel 124 hinged at 126 to panel 118 is folded back against and adhered to the inside surface of panel 118. The fold 126 between those panels forms a relatively thick flange or shelf which, when the box is closed, engages the correspondingly thick front wall of bottom section 12 at fold line 46 as shown in FIG. 2.

The forward edge of display panel 16 is hinged at fold line 128 to panel 124. Panel 16 extends rearwardly from panel 124 to the inner rear wall panel 64*a* of bottom section 12. At that point, it is hinged along a fold line 132 to a panel extension 16*a* which extends down flush against the rear wall panel 64*a*. A further short panel extension 16*b* is hinged at 134 to the bottom edge of panel extension 16*a* opposite fold line 132. When the box is made up, that panel extension 16*b* lies flush against the box bottom wall panel 42 as shown in FIGS. 1 and 2. As shown in FIG. 4, panel extensions 16*a* and 16*b* are somewhat narrower than panel 16 so that they fit nicely between the bottom section inner side wall panels 52*b*.

Figure 3:
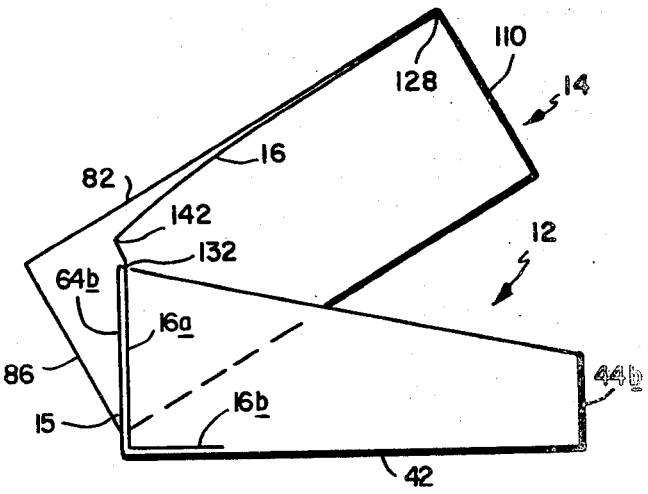
FIG. 3 is a diagrammatic side sectional view showing the operation of the FIG. 1 box.

Finally, as best seen in FIGS. 1 and 3, panel 16 is formed with a score or fold line 142 above and parallel to fold line 132. In some applications, a second score or fold line 144 may be formed in panel extension 16*a* below and parallel to fold line 132.

Referring now to FIGS. 1 to 3, when the box is closed as shown in FIG. 2, the panel 16 rests flush against the inside of cover panel 82, while the panel extension 16*a* lies against the bottom section rear wall panel 64*a*. Also, the fold 126 between cover panels 118 and 124 abuts the folded edge 46 between the bottom section front wall panels 44*a* and 44*b*. Resultantly, the bottom edge of the cover defined by the fold lines 15, 96 and 116 is spaced a determined distance upwards from the bottom of the box as shown in FIG. 2. Thus a plurality of such boxes arranged side by side or in a stack all have the same appearance and are in parallelism. Further, if the cover and bottom section are printed in different colors, a distinctive band appears all around the box at the bottom thereof. Also, the cover edge at 116 is readily accessible to facilitate opening the box 10.

When the box is opened, the cover 14 swings or pivots about the hinge line 15 near the bottom of the rear wall of section 12. This hinge line lies below the bottom sectipon rear wall upper edge at 84. Therefore, the panel extension 16*a* is not free to swing back with the cover rear wall panel 86, being prevented from doing so by panel 64*a*. Consequently, as the cover 14 is swung rearwardly, the rear edge of panel 16 is swung out away from the cover so that, when the box is fully opened as shown in FIG. 1, the panel 16 is angled upwardly and forwardly so that the printed advertising 18 thereon is clearly visible to the observer.

Further, panel 16 is also prevented from swinging rearwardly along with the cover panel 82. Consequently, panel 16 flexes as shown in FIG. 3 as the cover is swung back until panel 16 is more or less aligned with panel extension 16*a*. At that point, panel 16 assumes an overcenter position. It then folds about fold lines 132 and 142 so that panel 16 snaps forwardly to the position illustrated in FIG. 1 while cover 14 assumes its fully open position.

Thus if cover 14 is only opened a small amount, and that opening force is removed, the flexed panel 16 will bias the cover back to its fully closed position shown in FIG. 2. On the other hand, once the cover is opened to the point where panel 16 exceeds its over-center position, panel 16 will snap forwardly preventing the cover from closing of its own volition and indeed biasing it toward its fully open position shown in FIG. 1. Further, the panel 16, along with cover hinge 15, establishes the open position of the cover.

Similarly, when the cover 14 is swung closed, the portion of panel extension 16*a* is prevented from swinging forwardly by the carton contents. Accordingly, the panel 16 is again flexed until it is swung beyond its overcenter position, i.e. beyond extension 16*a*, whereupon the panel 16 resumes its normal unstressed position flush against panel 82 so that the cover 14 as a whole is free to close completely. Thus the panel 16 and its extension function as a bi-stable element which tends to maintain the cover in either its open or its closed position and to prevent inadvertent movement of the cover between those two positions.

Figure 5:
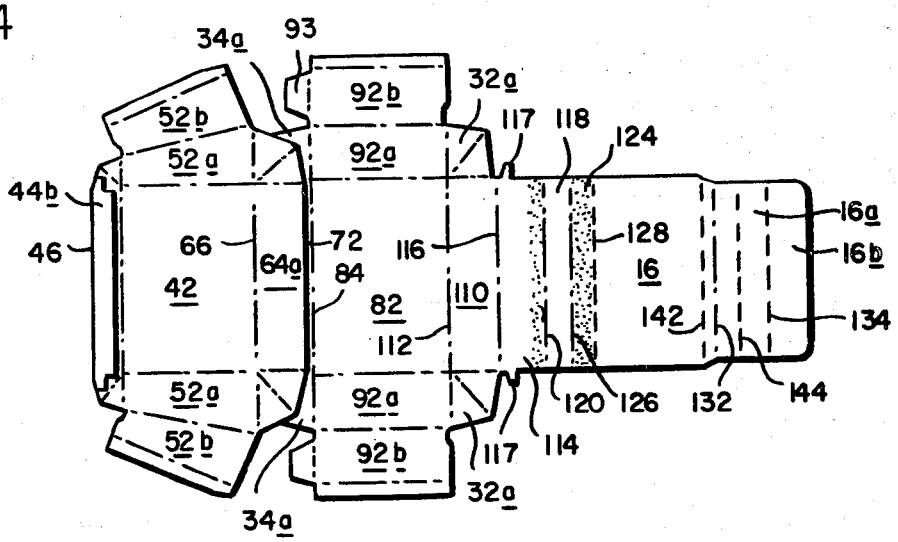
FIGS. 5 and 6 are similar views showing the folding and glueing sequences used to form the knocked-down box from the FIG. 4 blank.
Figure 6:
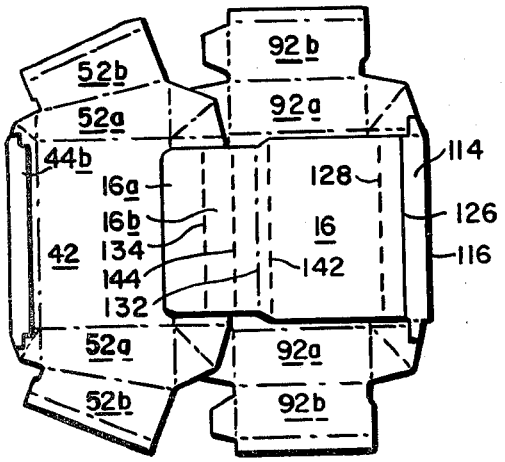

Referring now to FIGS. 4 to 6, the box 10 is formed from the blank illustrated in FIG. 4. The printed material on the box including the advertising 18 is all printed on the same face of the blank, specifically the surface thereof not shown in FIG. 4. The glued areas on the panels are indicated by stippling.

In order to make the box, the blank is folded along hinge line 15 from left to right. Then glue is applied to the face of panel 64*b* which is exposed after said folding, i.e. the undersurface in FIG. 4. Then the blank is reverse folded along hinge line 72 as illustrated in FIG. 5, thereby adhering panel 64*a* to panel 64*b*. Also glue is applied to panel 44*b* and that panel is folded along hinge line 46 flush against panel 44*a* as seen in FIG. 5. Next, glue is applied to panels 114 and 124 as indicated by the stippled areas thereon. Then the blank is folded along hinge line 116 from right to left and reverse folded at hinge line 120 from left to right and folded again at hinge line 126 from right to left so that it assumes the flattened shape illustrated in FIG. 6. That is the condition in which the box is maintained in inventory and shipped to the company which erects and fills the box.

To erect the box, the wall panels 44*a* and 44*b* and 64*a* and 64*b* of the bottom section are folded up vertically relative to panel 42, the pleats 26 and 28 are folded against the side wall panels 52*a* as shown in FIG. 1. Then the side wall panels 52*b* are folded down inside the bottom section flush against panels 52*a* with the short panels 58 overlying the bottom panel 42.

The cover 14 is erected in more or less the same way. The cover front and rear wall panels are folded vertically relative to the top wall panel 82, the pleats 32 and 34 are folded against the outer side wall panels 92*a* and then the inner side wall panels 92*b* are folded up inside the cover to retain the pleats in place, with the narrow panel extensions 102 lying against panel 82.

Finally, the panel 16 is placed against the cover panel 82 with its extension 16*a* overlying the bottom section rear wall panel 64*a* and extension 16*b* lying flush against the box bottom wall 42. If desired, the extension 16*b* may be slid under the side wall panel extensions 58 as shown in FIG. 1.

The box 10 can now be filled with articles or, if desired, a platform made of paperboard or molded plastic may be inserted into the carton bottom section 12 with the understanding that such platform will not extend above the fold line 144 in the panel extension 16*a*.

Figure 7:
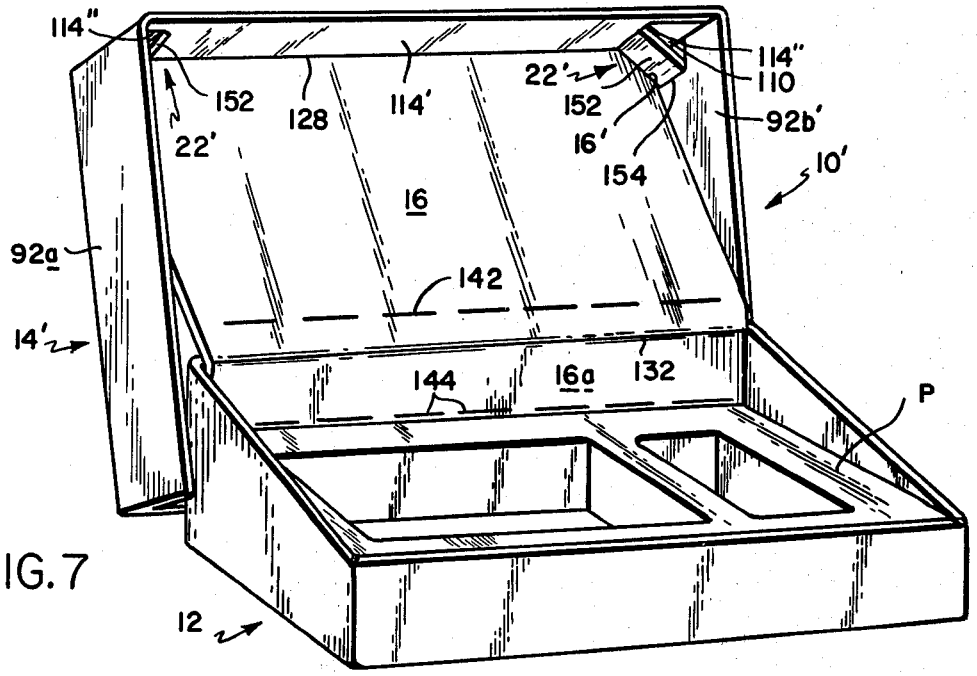
FIG. 7 is a perspective view of another embodiment of the display box.
Figure 8:
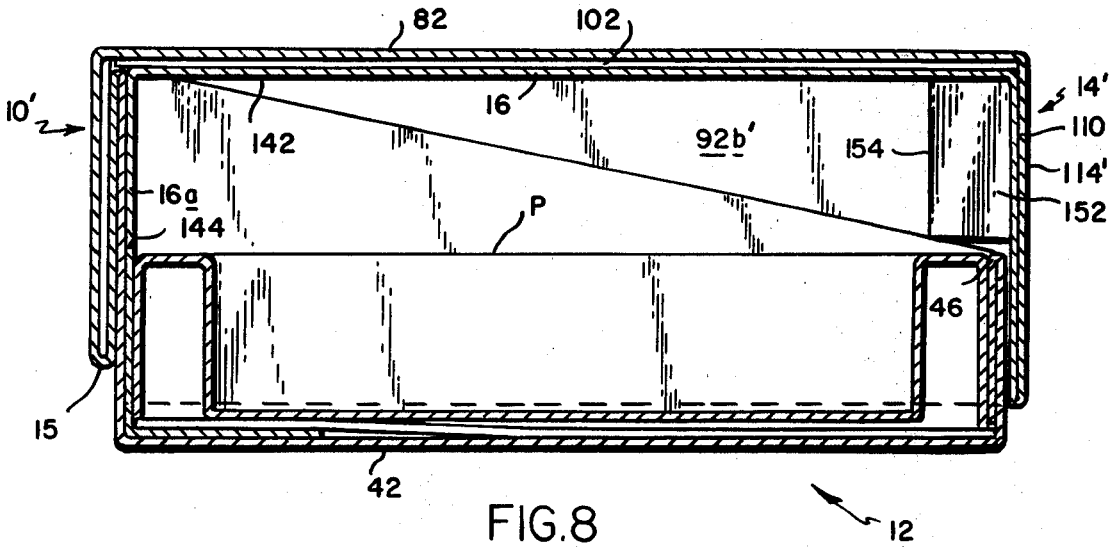
FIG. 8 is a vertical sectional view of the FIG. 7 box.

FIGS. 7 and 8 illustrate a slightly different box embodiment 10' employing a somewhat different stop means 22' for establishing the closed position of the box. Instead of using stop means which extend across the front of the box cover 14 as in FIG. 1, the FIGS. 7 and 8 version utilizes for this purpose a pair of bridging tabs 152 located at the front corners of the box cover 14'. In all other respects, the box 10' is more or less the same as box 10 illustrated in FIG. 1. Also FIG. 7 illustrates a platform P seated in the bottom section 12 of the type commonly used with this type of container. A similar platform may be seated in box 10. As seen from FIG. 7, the upper surface of the platform P is situtated at or below the hinge line 144 on the panel extension 16*a*. The panel elements in box 10' which are the same or similar to those in the FIG. 1 box 10 carry the same identifying numerals.

Figure 9:
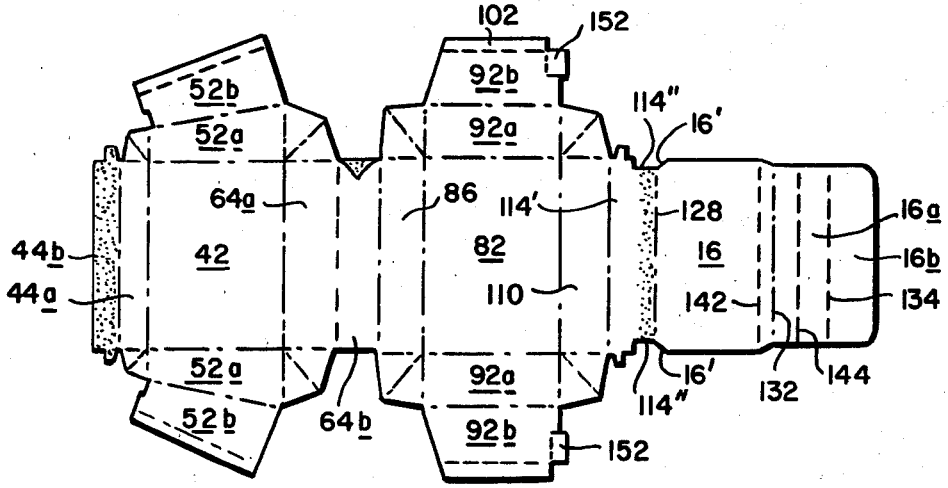
FIG. 9 is a top plan view of the blank used to make the FIG. 7 box.

The FIG. 7 box embodiment has slightly different cover inner side wall panels indicated at 92*b'*. More particularly, those panels are provided with small hinged end tabs 152 which project beyond the side edges of those panels and overhang panel 110 as illustrated in FIG. 9. Also, in place of the panels 114, 118 and 124 illustrated in FIG. 4, the box 10' has a single front wall panel 114' hinged between panels 110 and 16. Furthermore, the opposite ends of panel 114' are notched at 114'' adjacent the hinge line 128 to panel 16.

The bottom section 12 is erected in the same way described above in connection with FIG. 1. The cover 14' is also assembled in much the same way in that its front and rear wall panels are folded perpendicular to the top panel 82 with the pleats 32 and 34 folded against the side wall panels 92*a*. Then the side wall panels 92*b'* are folded against the inside of panels 92*a* as illustrted in FIG. 7. Since the tabs 152 extend beyond the edges of panels 92*b'*, they engage the front wall panel 114' and are bent outwards out of the plane of the plane of the panel 92*b'* to which they are hinged. When the side wall panels 92*b'* are flush against panels 92*a*, the ends of tabs 152 engage the edges of notches 114'' thereby locking the panels 92*b'* in place. The side edges of panel 16 adjacent its hinge line 128 are beveled as shown at 16' in FIG. 9 so that, when that panel swings out away from cover panel 82 when the box is opened, the panel 16 edges will clear the tabs 152, with the short cover panel extensions 102 being deflected downwardly to permit panel 16 to rest below panel extensions 102 as shown in FIG. 8.

The FIG. 7 box has all of the advantages of the one illustrated in FIG. 1. Additionally, however, it uses less board materials as seen by comparing FIGS. 4 and 9. The platform P, whether used in the FIG. 1 or the FIG. 7 box, helps to maintain the shape of the bottom section 12 to assure that the stop means 22 or 22' are aligned with the upper edge of the bottom section so that those parts assuredly abut one another to define the closed position of the cover.

Various modifications may be made in the above constructions without departing from the scope of the invention. For example, the side wall edges of the box bottom section 12 can be horizontal rather than inclined. Also, the score line 142 may be located further up along the panel 16. Preferably, however, it should be located near the hinge line 132 or near the hinge line 128 as shown in phantom at 142' in FIG. 1 so that panel 16 is not creased in the middle of the advertising material thereon. Both of the illustrated constructions provide a secure enclosure for the box contents as well as an attractive display platform therefor. Both are manufactured and assembled from a single blank of board material and both require printing on only one side of that blank. Finally, the box can be stored and shipped in a flattened condition. Therefore, the box should find wide application wherever articles of merchandise are to be displayed at points of sale.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A display box formed from a single material blank, said box comprising

A. a generally rectangular bottom section having bottom, front, rear and side walls and a top opening;

B. a cover
  (1) having top, front, rear and side walls and a bottom opening; and
  (2) sized slightly larger than the bottom section;

C. a hinge connecting the rear walls of the bottom section and cover so that the cover can swing between
  (1) a closed position wherein it engages over and closes the bottom section; and
  (2) an open position wherein it extends upwardly rearwardly forming an obtuse angle with the bottom section;

D. a display panel;
  (1) positioned in said cover;
  (2) extending into the bottom section;
  (3) having one end hinged at the junction of the cover top and front walls; and
  (4) having an opposite end portion secured against the bottom section rear wall;

E. a first hinge line extending across the display panel and which is opposite and substantially parallel to the upper edge of the bottom section rear wall when the cover is in its open position;

F. a second hinge line extending across the display panel and spaced substantially parallel to the first hinge line so that
  (1) when the cover is in its closed position, the panel lies more or less against the inside of the cover top wall; and
  (2) when the cover is in its open position, the panel opposite end portion is swung out of the cover so that the panel is substantially flat and angled upwardly so that it helps to establish the open position of the cover and is readily visible to an observer; and G. means for establishing the closed position of the cover, said establishing means comprising a panel
  (1) integral with the display panel;
  (2) adhered to the inside of the cover front wall; and (3) having a height less than the height of the cover front wall so as to form a stopper edge which engages the top edge of the bottom section front wall when the cover is in its closed position.

2. The box defined in claim 1 wherein the panel length between said one end of the panel and said first hinge line is selected so that the panel is flexed as it assumes an over-center position when the cover is partially open, sufficiently to function as a toggle tending to bias the cover toward its open and closed positions.

3. The box defined in claim 1 wherein all the exterior surfaces of the bottom section and cover and the exposed surface of the display panel comprise finished surfaces lying on the same face of the blank used to form the box.

4. The box defined in claim 1 wherein the bottom section front wall is shorter than the bottom section rear wall.

5. The box defined in claim 1 and further including reinforcing pleats formed at the front and rear corners of the bottom section and at the front corners of the cover.

6. The box defined in claim 1 and further including a third hinge line extending across the display panel A. parallel to the first hinge line; and B. positioned on the opposite side of the first hinge line from the second hinge line.

7. The box defined in claim 6 and further including a raised platform snugly seated in the bottom section, the rear edge margin of said platform extending no higher than said hinge line closest to the bottom section bottom wall.

8. The box defined in claim 1 wherein the second hinge line is spaced above and relatively close to the first hinge line.

9. The box defined in claim 1 wherein the second hinge line is spaced relatively close to said one end of the display panel.

10. A display box formed from a single material blank, said box comprising

A. a generally rectangular bottom section having bottom, front, rear and side walls and a top opening;

B. a cover (1) having top, front, rear and side walls and a bottom opening; and (2) sized slightly larger than the bottom section;

C. a hinge connecting the rear walls of the bottom section and cover so that the cover can swing between (1) a closed position wherein it engages over and closes the bottom section; and (2) an open position wherein it extends upwardly rearwardly forming an obtuse angle with the bottom section;

D. a display panel;

(1) positioned in said cover;

(2) extending into the bottom section;

(3) having one end hinged at the junction of the cover top and front walls; and (4) having an opposite end portion secured against the bottom section rear wall;

E. a first hinge line extending across the display panel and which is opposite and substantially parallel to the upper edge of the bottom section rear wall when the cover is in its open position;

F. a second hinge line extending across the display panel and spaced substantially parallel to the first hinge line so that (1) when the cover is in its closed position, the panel lies more or less against the inside of the cover top wall; and (2) when the cover is in its open position, the panel opposite end portion is swung out of the cover so that the panel is substantially flat and angled upwardly so that it helps to establish the open position of the cover and is readily visible to an observer; and G. means for establishing the closed position of the cover, said establishing means comprising a pair of tabs having (1) corresponding first ends connected to the cover side walls adjacent the front corners of the cover; and (2) corresponding second ends engaging opposite ends of the cover front wall so that the tabs bridge the front corners of the cover, the height of the tabs being less than the height of the cover front and side walls so as to form abutments which engage the tops of the bottom section front and side walls when the cover is in its closed position.

11. A display box formed from a single material blank, said box comprising

A. a generally rectangular bottom section having bottom, front, rear and side walls and a top opening;

B. a cover (1) having top, front, rear and side walls and a bottom opening; and (2) sized slightly larger than the bottom section;

C. a hinge connecting the rear walls of the bottom section and cover so that the cover can swing between (2) a closed position wherein it engages over and closes the bottom section; and (2) an open position wherein it extends upwardly rearwardly forming an obtuse angle with the bottom section;

D. a display panel (1) having one end hinged to the cover adjacent the front wall thereof;

(2) having its opposite end hinged at the bottom section rear wall; and (3) having a length between said ends such that, when said cover is swung to its open position, the portion of the display panel above the bottom section rear wall swings out of the cover whereby the panel assumes a substantially flat, upwardly angled position between the cover and the bottom section so that it helps to establish the open positio of the cover and is readily visible to an observer; and E. a panel (1) adhered to the inside of the cover front wall; and (2) having a height less than that of the cover front wall so as to form a stopper edge in the cover which engages the top edge of the bottom section front wall when the cover is in its closed position, thereby to establish the closed position of the cover.

12. The box defined in claim 11 wherein the display panel has

A. a first hinge line extending across the display panel and which lies oposite the top edge of the bottom section rear wall when the cover is in its open position;

B. a second hinge line extending across the display panel spaced above and parallel to the first hinge line; and C. a third hinge line extending across the display panel sapced below and parallel to the first hinge line.

13. A display box formed from a single material blank, said box comprising

A. a generally rectangular bottom section having bottom, front, rear and side walls and a top opening;

B. a cover (1) having top, front, rear and side walls and a bottom opening; and (2) sized slightly larger than the bottom section;

C. a hinge connecting the rear walls of the bottom section and cover so that the cover can swing between (1) a closed position wherein it engage over and closes the bottom section; and (2) an open position wherein it extends upwardly rearwardly forming an obtuse angle with the bottom section;

D. a display panel (1) having one end hinged to the cover adjacent the front wall thereof;

(2) having its opposite end hinged at the bottom section rear wall; and (3) having a length between said ends such that, when said cover is swung to its open position, the portion of the display panel above the bottom section rear wall swings out of the cover whereby the panel assumes a substantially flat, upwardly angled position between the cover and the bottom section so that it helps to establish the open position of the cover and is readily visible to an observer; and E. a pair of tabs having (1) corresponding first ends connected to the cover side walls adjacent the front corners of the cover; and (2) corresponding second ends engaging the opposite ends of the cover front wall so that the tabs bridge the front corners of the cover, the heights of the tabs being less than the height of the cover front and side walls so as to form abutments which engage the tops of the bottom section front and side walls when the cover is in its closed position, thereby to establish the closed position of the cover.

14. A blank form forming a box having a bottom section, a cover hinged to the bottom section and a display panel extending between the cover and the bottom section which swings out when the cover is swung to its open positon, said blank comprising A. bottom section means including a bottom panel and a side wall integrally attached to said bottom panel;

B. cover means including a top panel and a side wall integrally attached to the top panel;

C. first panel means hingedly connecting the cover side wall to the bottom section side wall;

D. a display panel hingedly connected to the cover side wall, the length of said display panel being greater than the length of the cover top panel, the hinge connection of the display panel to the cover side wall comprising a series of three hinged-together panels, the first panel in the series having a height which is substantially the same as that of the cover side wall and the second and third panels in the series being of equal height which is approximately one-half the height of the first panel in the series, and said three panels being adapted to establish a stopper edge on the cover for engaging the bottom section side wall when the cover is in its closed position;

E. a first hinge line extending across the display panel and spaced parallel to the hinged connection of said display panel to the cover side wall at a distance therefrom somewhat greater than the length of the cove top panel; and F. a second hinge line extending across the display panel and spaced parallel to the first hinge line between the first hinge line and the hinge connection of the display panel to the cover side wall.

15. The blank defined in claim 14 and further including a third hinge line extending across the display panel parallel to the first hinge line and spaced on the opposite side thereof from the second hinge line by a distance less than the height of the bottom section side wall.

16. A blank for forming a box having a bottom section, a cover hinged to the bottom section and a display panel extending between the cover and the bottom section which swings out when the cover is swung to its open positon, said blank comprising A. bottom section means incuding a bottom panel and a side wall integrally attached to said bottom panel;

B. cover means including a top panel and a side wall integrally attached to the top panel, said cover side wall comprising (1) side panels on opposite sides of the cover top panel;

(2) a front panel attached at the free end of the cover top panel;

(3) a back panel attached to a side of the cover top panel opposite said cover front panel; and (4) a tab extending from each cover side panel in the direction of the longitudinal axis of the blank and adapted to bridge the front corners of the cover to function as abutments for engaging the bottom section side wall when the cover is in its closed position;

C. first panel means hingedly connecting the cover side wall to the bottom section side wall;

D. a display panel hingedly connected to the cover side wall, the length of said display panel being greater than the length of the cover top panel;

E. a first hinge line extending across the display panel and spaced parallel to the hinged connection of said display panel to the cover side wall at a distance therefrom somewhat greater than the length of the cover top panel; and F. a second hinge line extending across the display panel and spaced parallel to the first hinge line between the first hinge line and the hinge connection of the display panel ot the cover side wall.

* * * * *